US012098491B2

(12) United States Patent
Moore

(10) Patent No.: US 12,098,491 B2
(45) Date of Patent: Sep. 24, 2024

(54) TWO COMPONENT TUB SUPPORT SYSTEM

(71) Applicant: Sonoco Development, Inc., Hartsville, SC (US)

(72) Inventor: Clifton Moore, Murfreesboro, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/846,194

(22) Filed: Jun. 22, 2022

(65) Prior Publication Data

US 2023/0416968 A1 Dec. 28, 2023

(51) Int. Cl.
*D06F 39/00* (2024.01)
*D06F 39/12* (2006.01)

(52) U.S. Cl.
CPC ..... *D06F 39/001* (2013.01); *D06F 39/12* (2013.01)

(58) Field of Classification Search
CPC ..... D06F 39/001; D06F 39/12; B65D 2585/6855; B65D 85/68; B65D 2581/053; B65D 5/4266; B65D 81/02; B65D 5/02; B65D 5/18; B65D 5/42; B65D 5/5035; B65D 81/05; B65D 81/127; B65D 5/241; B65D 5/20
USPC ..... 68/3 R; 220/320, 592, 593, 594
See application file for complete search history.

(56) References Cited

U.S. PATENT DOCUMENTS 3,184,048 A * 5/1965 Bjerum ..... D06F 39/001 68/3 R
3,187,887 A * 6/1965 Charles ..... D06F 39/001 68/3 R
3,620,365 A * 11/1971 Elwell ..... D06F 39/001 206/320
3,912,076 A * 10/1975 Elwell ..... D06F 39/001 206/320
4,832,190 A * 5/1989 Favreau ..... B65D 85/68 206/521
2008/0168803 A1* 7/2008 Muyskens ..... D06F 39/001 68/23.3
2008/0264806 A1* 10/2008 Trebilcock ..... D06F 39/001 206/207
2015/0122680 A1* 5/2015 Kim ..... B65D 81/02 206/320
2015/0337479 A1* 11/2015 Senn ..... D06F 39/00 206/320
2021/0139230 A1* 5/2021 Bischoff ..... B65D 85/64

FOREIGN PATENT DOCUMENTS

KR 19990032956 A * 5/1999

OTHER PUBLICATIONS

Machine translation of KR-19990032956-A (Year: 1999).*
International Search Report and Written Opinion related to Application No. PCT/US2023/025940; reported on Oct. 1, 19, 2023.

* cited by examiner

*Primary Examiner* — David G Cormier
*Assistant Examiner* — Thomas Bucci
(74) *Attorney, Agent, or Firm* — von Briesen & Roper, s.c.

(57) ABSTRACT

A tub support system that fits inside the top opening of a washing machine to prevent the wash tub from moving relative to the cabinet during shipping and handling. The tub support system comprises two separate components held in interlocking engagement. One component contacts the tub and the other component contacts the cabinet.

12 Claims, 5 Drawing Sheets

TWO COMPONENT TUB SUPPORT SYSTEM

BACKGROUND OF THE INVENTION

Field of the Invention

This disclosure relates to the field of appliance packaging. More particularly, this disclosure relates to a device that fits inside a top opening of a washing machine to prevent the wash tub from moving relative to the outer cabinet during shipping and handling.

Description of the Related Art

Top-loading washing machines generally comprise a spin or wash tub disposed within a washing machine cabinet or housing. The tubs and transmissions of some washing machines are mounted to the bottom plate of the structure. A more common design includes the tub and transmission supported from suspension rods mounted on the underside of the washing machine top surface. Machines with the hung suspension mounting systems must be packaged in a way to prevent the tub/transmission assembly from moving (both laterally and vertically) during shipment. Both washing machine designs may or may not use a central agitator.

In either type of washing machine, the clearance between the tub and the cabinet is often no more than an inch (2.54 cm). As a consequence, unsecured tub/transmission assemblies can cause outward dents in the machine cabinet during product distribution.

Thus, there is a need for a device that locks the tub in place or otherwise prevents the tub from impacting the cabinet when the washing machine is moved.

The present disclosure is designed to solve the problem described above.

BRIEF SUMMARY OF THE INVENTION

The present disclosure relates to a tub support system that fits inside the top opening of a washing machine to prevent the wash tub from moving relative to the cabinet during shipping and handling.

In an embodiment, the tub support system comprises a lower tub support and an upper tub support held together in interlocking engagement. The lower tub support may be "barbell" shaped and is configured to contact opposing sides or areas of the wash tub. The upper tub support is configured to contact opposing sides or areas of the cabinet and, optionally, areas of the wash tub. Each component is made from a single folded blank. Together the two interlocking components prevent the wash tub from moving relative to the cabinet during shipping and handling.

DETAILED DESCRIPTION OF THE INVENTION

Figure 1:
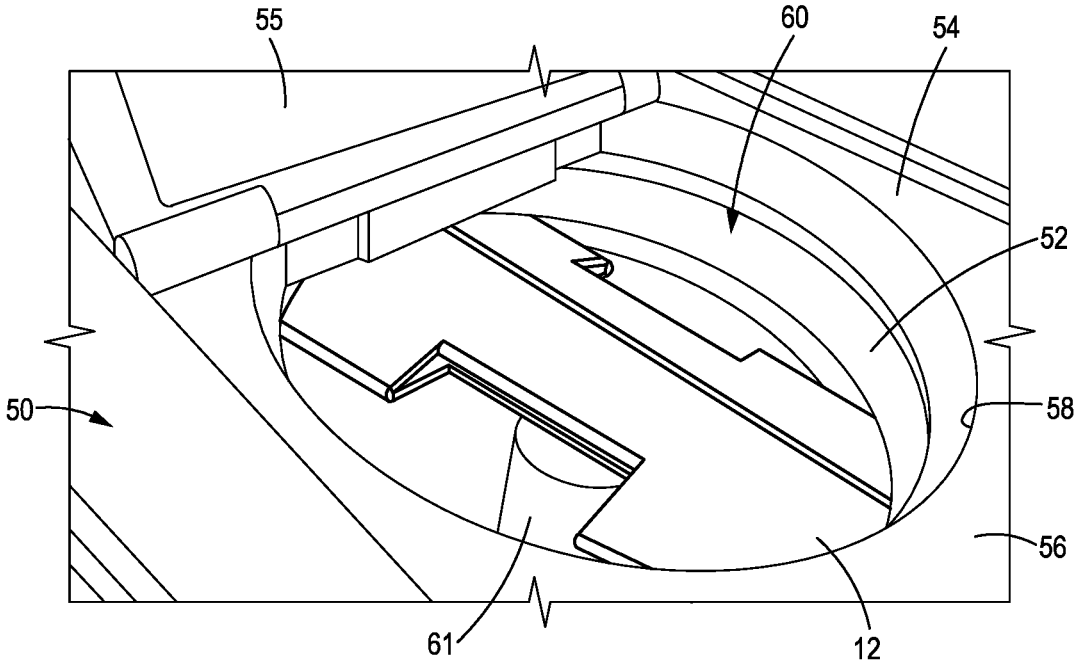
FIG. 1 is a top perspective view of a lower tub support according to the present disclosure shown installed in a washing machine.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "upper" and "lower", "vertical" and "horizontal", "top" and "bottom," "front" and "back," (etc.), used as nouns, adjectives or adverbs refer in this description to the orientation of the structure and orientation of the tub support as it is illustrated in the various views. Such terms are not intended to limit the invention to a particular orientation.

Turning to the drawings, where like numerals indicate like elements, there is shown in FIG. 1 a top perspective view of a lower tub support 12 according to the present disclosure shown installed in a washing machine 50. The washing machine 50 itself comprises a wash tub 52, a cabinet 54 and a lid 55 hingedly attached to the cabinet 54 or to a structural frame (not shown) inside the cabinet 54. In the figure, the washing machine 50 has a central agitator 61.

The cabinet 54 has a top surface 56 that extends inwardly from the sides of the cabinet to a rim 58 that defines a top opening 60 having a diameter. The rim 64 may be circular, D-shaped, or any suitable shape.

The wash tub 52 is located within the cabinet 54 and may be suspended from the cabinet 54 or from the structural frame inside the cabinet 54. The wash tub 52 can swing or otherwise move from its center position and impact the walls of the cabinet 54 from the inside if not restrained. These impacts can produce a cosmetic defect to the outside of the cabinet 54.

As noted above, a device is needed that fits inside the top opening 60 to prevent the wash tub 52 from moving relative to the cabinet 54 during shipping and handling. A tub support system 10 has been designed to meet this need.

Tub Support System 10

Figure 2:
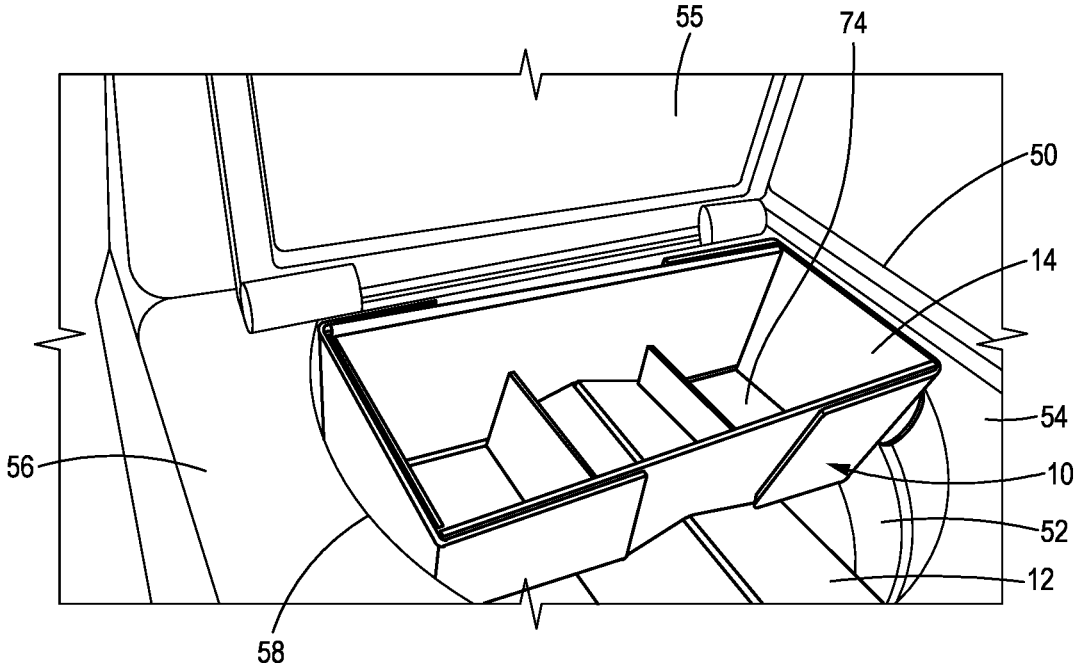
FIG. 2 is a top perspective view of a tub support according to the present disclosure shown installed in a washing machine, the tub support comprising a lower tub support and an upper tub support.

FIG. 2 is a top perspective view of a tub support system 10 according to the present disclosure shown installed in a washing machine 50. The tub support system 10 comprises a lower tub support 12 like the one shown in FIG. 1 and an upper tub support 14. The lower tub support 12 is configured to contact opposing sides or areas of the wash tub 52. The upper tub support 14 is configured to contact opposing sides or areas of the cabinet 54 and, optionally, sides or areas of the wash tub 52. The tub support system 10 prevents significant movement of the wash tub 52 relative to the cabinet 54.

The upper tub support 14 is held in interlocking engagement with the lower tub support 12 so that the two components form a single rigid or semi-rigid structure when installed in a wishing machine. The fact that each component can be installed separately renders it easier to install the entire tub support system 10.

More specifically, the upper tub support 14 defines an opening or gap 90 in its bottom wall 74 configured to receive a middle portion 35 of the barbell shaped lower tub support 12 to lock the two components together in a substantially perpendicular orientation.

The Lower Tub Support 12

Figure 3:
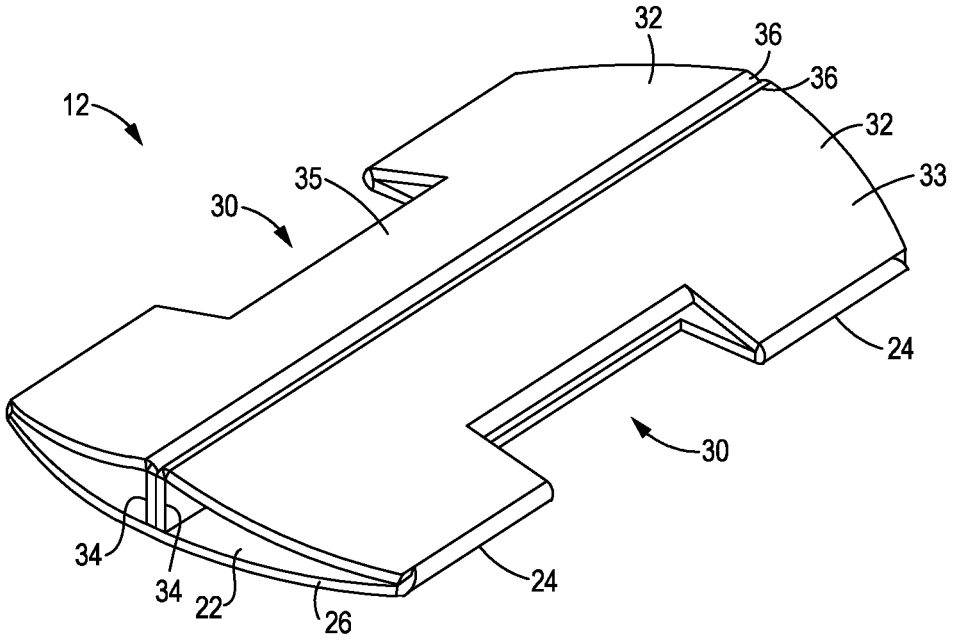
FIG. 3 is a top perspective view of the lower tub support of FIG. 1.
Figure 4:
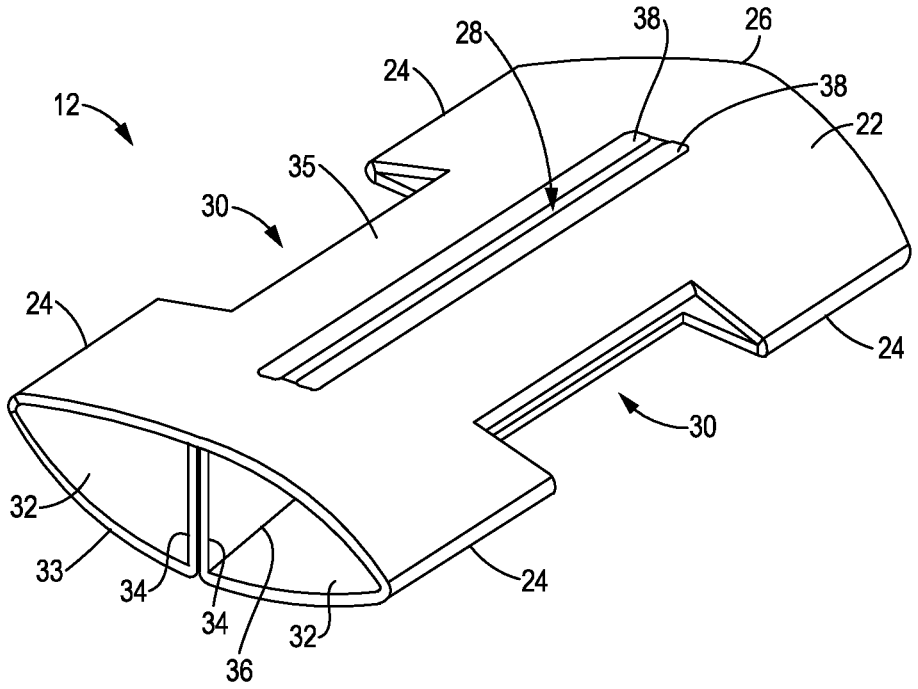
FIG. 4 is a bottom perspective view of the lower tub support of FIG. 1.

FIG. 3 is a top perspective view and FIG. 4 is a bottom perspective view of the lower tub support 12 of FIG. 1. In general, the lower tub support 12 comprises a bottom panel 22, two top panels 32, two vertical panels 34 and two bottom tabs 38.

The bottom panel 22 has parallel side edges 24 that also function as fold lines 24 and two curved or otherwise contoured free edges 26. The free edges are shaped to complement the interior shape of the wash tub 52. The bottom panel 22 defines a center slot 28 for receiving the bottom tabs 38 as explained further below.

A top panel 32 is foldably attached to each side edge 24 of the bottom panel 22 so that, when folded inwardly (toward each other) the top panels 32 form the top side 33 of the lower tub support 12, where the top side 33 has substantially the same dimensions as the bottom panel 22. Preferably the two top panels 32 slant upwardly to a pair of fold lines 36 so that the top panels 32 (or portions thereof) fit snugly within the gap 90 on the underside of the upper tub support 14.

Each side of the lower tub support 12 defines a side notch 30. More specifically, the bottom panel 22 and each top panel 32 define a side notch 30. The portion of the lower tub support 12 located between the side notches 30 may be referred to as the middle portion 35. Each side notch 30 straddles, and thus interrupts, a side edge 24.

Each vertical panel 34 is foldably attached to a top panel 32 along a second fold line 36. In the assembled lower tub support 12, the vertical panels 34 are substantially perpendicular to the top panels 32. In FIG. 3 the vertical panels 34 extend downwardly from the top panel 32 to or slightly through the center slot 28 in the bottom panel 22. Preferably the vertical panels 34 are in flat facing abutment with each other.

Each bottom tab 38 is foldably attached to a vertical panel 34 along a tab fold line 39. In FIG. 4 the bottom tabs 38 extend outwardly (away from each other) from the vertical panels 34 beyond the center slot 28 in the bottom panel 22. Preferably the bottom tabs 38 form a substantially right angle with the vertical panels 34 to help maintain the final three dimensional "barbell" shape of the lower tub support 12, although in practice this right angle configuration often is not achieved.

Lower Tub Support Blank 20

Figure 5:
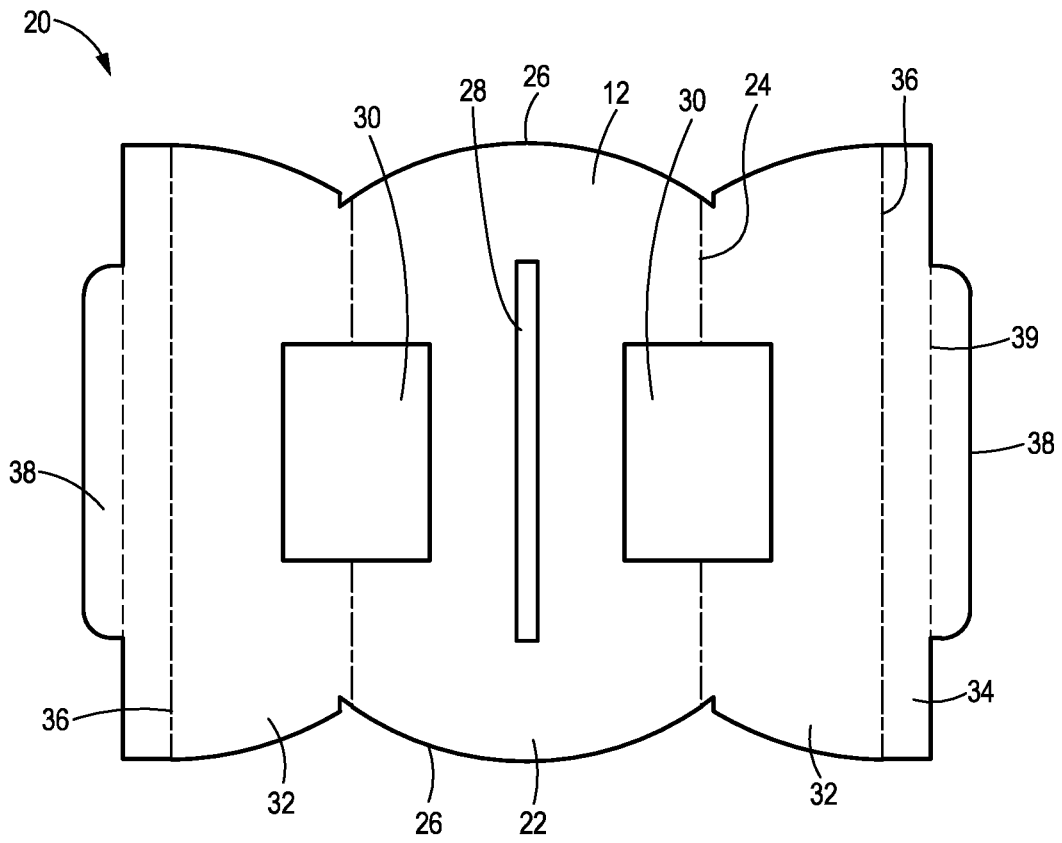
FIG. 5 is a top plan view of a blank for making the lower tub support of FIG. 1.

The lower tub support 12 may be made from a single unitary blank that is quickly and easily folded into the three dimensional structure shown in FIGS. 3 and 4. FIG. 5 is a top plan view of an exemplary blank 20 for making the lower tub support 12. The blank 20 comprises a bottom panel 22, two top panels 32, two vertical panels 34 and two bottom tabs 38.

The bottom panel 22 has a perimeter defined by two parallel side edges 24 and two curved or otherwise contoured free edges 26. The bottom panel 22 defines a center slot 28 configured to receive the bottom tabs 38 when the lower tub support 12 is assembled.

In the blank 20, a top panel 32 extends outwardly from each side edge 24 of the bottom panel 22. Together, the top panels 32 have a shape that is substantially the same as the bottom panel 22. Thus, the maximum dimension of each top panel 32, measured along the second fold line 36, is substantially equal to the maximum length of the bottom panel 22, measured along an axis co-linear with the center slot 28.

The bottom panel 22 and each top panel 32 define an opening 30 that straddles the side edge 24. In the assembled lower tub support 12, each opening 30 forms one of the side notches 30.

A relatively narrow vertical panel 34 is foldably attached to each top panel 32 along a second fold line 36. In the assembled lower tub support 12, these vertical panels 34 may be in flat facing abutment with each other as they extend vertically from the top panels 32 to the bottom panel 22. This, the width of the vertical panels 34 represents the maximum thickness (in the vertical direction) of the assembled lower tub support 12.

A bottom tab 38 is foldably attached to each vertical panel 34 along a tab fold line 39. In the assembled lower tub support 12, these bottom tabs 38 extend through the center slot 28 of the bottom panel 22 and are folded over about ninety degrees with respect to the vertical panels 34 so that secure the lower tub support 12 in its final, assembled configuration. Preferably the length of each bottom tab 38 is substantially the same or slightly less than the length of the center slot 28.

The Upper Tub Support 14

The upper tub support 14 is a separate structure from the lower tub support 12 but the two structures work in conjunction with each other to form the tub support system 10.

Figure 6:
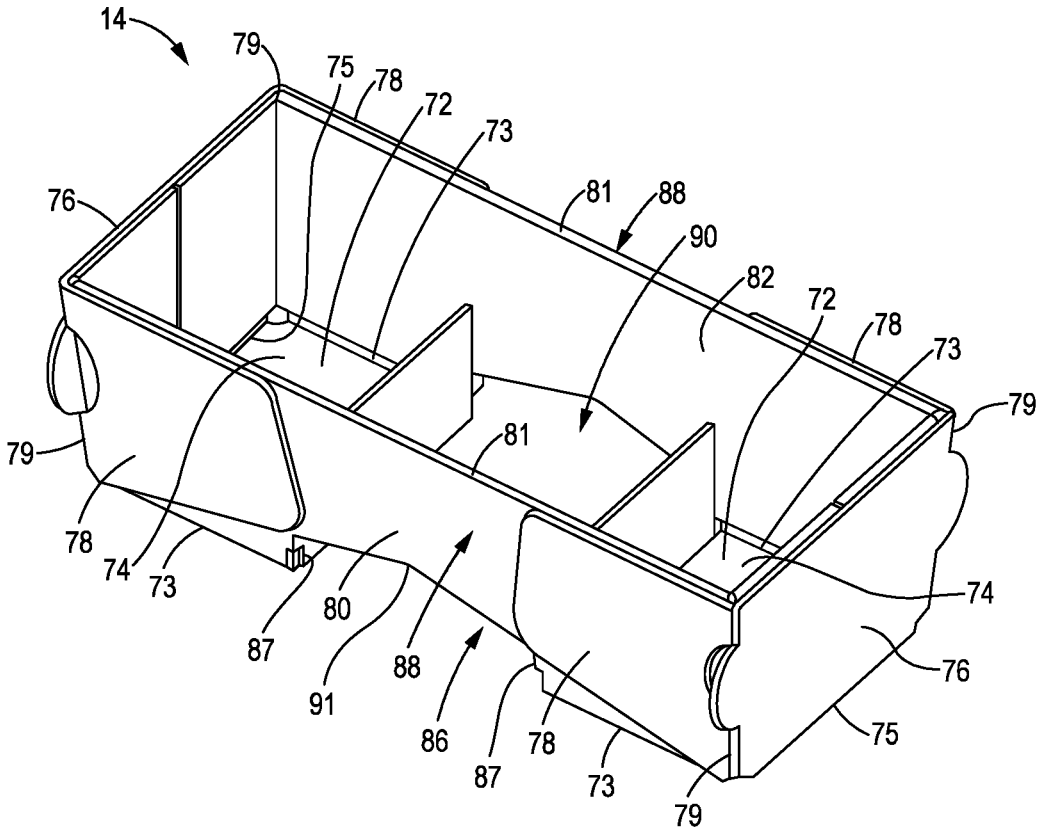
FIG. 6 is a top perspective view of an upper tub support according to the present disclosure.

FIG. 6 is a top perspective view of an upper tub support 14 according to the present disclosure. The upper tub support 14 comprises a bottom wall 74, two end panels 76 and two side walls 88. The upper tub support 14 is configured to lock onto the lower tub support 12 and contact opposing sides or areas of the cabinet 54.

The bottom wall 74 may be non-contiguous in that it comprises first and second bottom panels 72 separated by a gap 90. The gap 90 is sized to receive and frictionally engage the middle portion 35 of the lower tub support 12 to prevent relative movement of the lower tub support 12 and the upper tub support 14. The bottom wall 74 (including the gap 90) may be substantially rectangular and may have a perimeter defined by opposing bottom side fold lines 73 and opposing bottom end fold lines 75.

An end panel 76 is foldably attached to and extends upwardly from each bottom panel 72 along a bottom end fold line 75. The height of the end panels 76, as well as the height of the side walls 88, should be small enough to allow the washing machine lid 55 to close completely when the tub support system 10 is installed in a washing machine 50.

Each side wall 88 may comprise an outer side panel 80 and an inner side panel 82. Each outer side panel 80 is foldably attached to and extends upwardly from the bottom panels 72 along two co-linear segments of each bottom side fold line 73. Each outer side panel 80 terminates in a top edge 81 defined by a side panel fold line 81.

An inner side panel 82 is foldably attached to each outer side panel 80 along a side panel fold line 81 and extends downward from the side panel fold line 81. In the assembled upper tub support 14, each inner side panel 82 is folded 180 degrees inward along the side panel fold line 81 so that it is in flat facing abutment with the outer side panel 80 forming, in essence, a double-walled side wall 88.

A pair of end flaps 78 may be foldably attached to each end panel 76 along a fold line 79. Each end flap 78 is in flat facing relationship with an outer side panel 80. In these areas the side wall 88 is triple walled, meaning it has three layers of material. The end flaps 78 may be located on the outside of the upper tub support 14 as shown in FIG. 5 and may be adhered or otherwise affixed to the outer side panels 80. Alternatively, the end flaps 78 may be located on the inside of the upper tub support 14 and may be adhered or otherwise affixed to the inner side panels 82.

Preferably each side wall 88 of the upper tub support 14 defines a steepled notch 86 configured to receive a complementary shaped portion of the lower tub support 12. More specifically, the steepled notch 86 comprises two substantially vertical edges 87 and two upwardly slanted top edges 89 that meet at an apex 91.

The upper tub support 14 is configured to contact opposing sides or areas of the cabinet 54.

Upper Tub Support Blank 70

Figure 7:
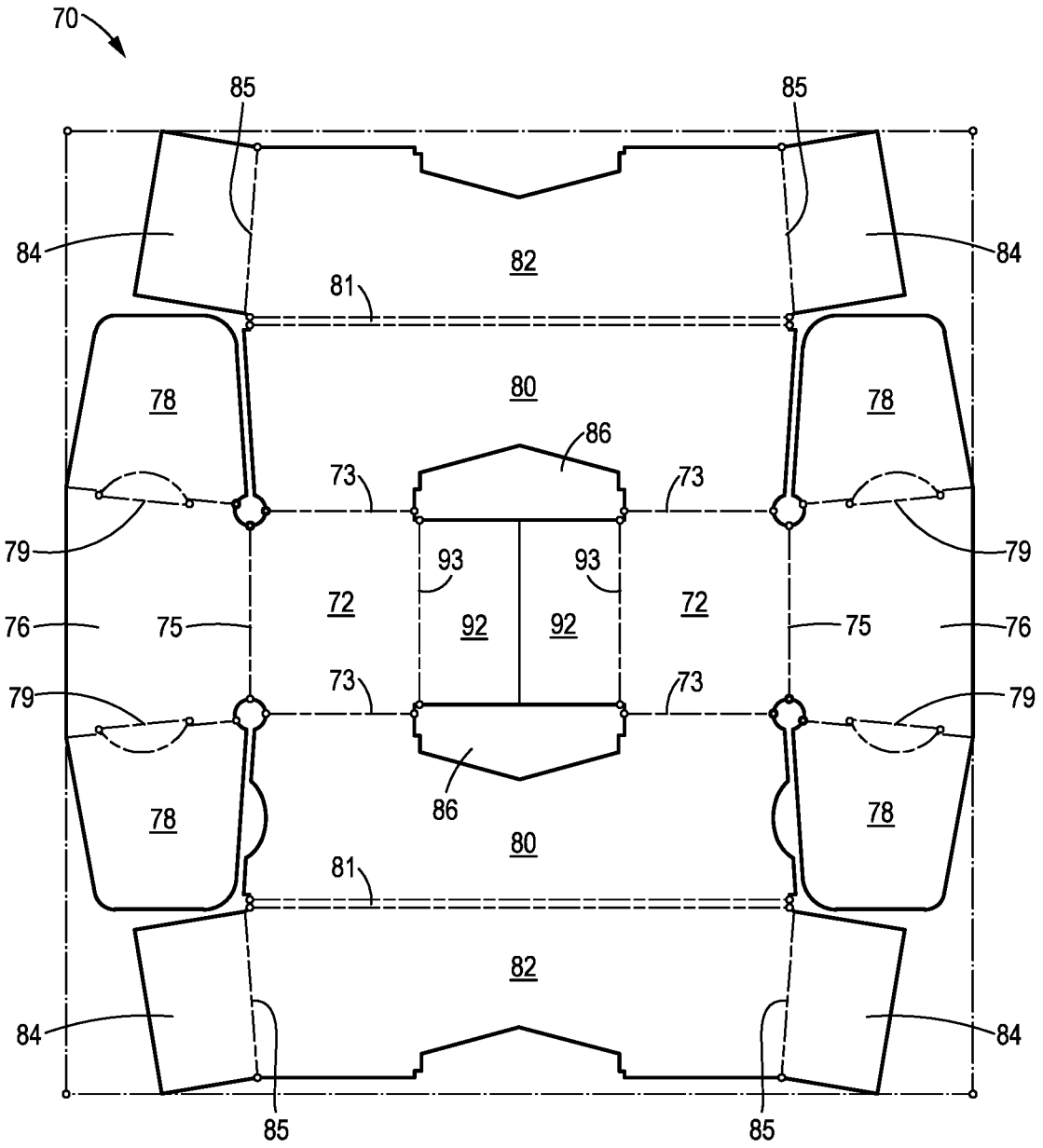
FIG. 7 is a top plan view of a blank for making the upper tub support of FIG. 6.

Like the lower tub support 12, the upper tub support 14 may be made from a single unitary blank. FIG. 7 is a top plan view of an exemplary blank 70 for making the upper tub support 14. The blank 70 may comprise first and second bottom panels 72, two end panels 76, four end flaps 78, two outer side panels 80, two inner side panels 82 and four side flaps 84.

The first and second bottom panels 72 define the bottom wall 74 in the assembled upper tub support 14. Each bottom panel 72 may be rectangular and may have a perimeter defined by opposing bottom side fold lines 73 and opposing bottom end fold lines 75.

Optionally, the blank 70 may comprise two gap panels 92 foldably attached to the bottom panels 72 along gap fold lines 93. When the assembled upper tub support 14 is fitted onto the lower tub support 12, these gap panels 92 fold upwardly, thereby creating the gap 90 into which the lower tub support 12 fits to form a frictional fit with the upper tub support 14.

An end panel 76 is foldably attached to each bottom panel 72 along a bottom end fold line 75. Each end panel 76 may be trapezoidal or any suitable shape.

A pair of end flaps 78 may be foldably attached to each end panel 76 along a fold line 79. Each pair of opposing fold lines 79 may diverge in the vertical direction. More specifically each pair of opposing fold lines 79 may diverge in the direction way from the bottom panel 72. The fold lines 79 form the four vertical corners 79 of the upper tub support 14 and may form the surfaces that abut the washing machine cabinet 54.

An outer side panel 80 is foldably attached to each pair of bottom panels 72 along each bottom side fold line 73. Each outer side panel 80 may be trapezoidal or any suitable shape.

An inner side panel 82 is foldably attached to each outer side panel 80 along a side panel fold line 81 opposite the bottom side fold lines 73. In the assembled upper tub support 14, the inner side panels 82 are folded 180 degrees along the side panel fold lines 81 so that they are in flat facing abutment with the outer side panels 80. In FIG. 6 the inner side panels 82 are located on a side of the outer side panels 80 opposite the end flaps 78. Alternatively, the inner side panels 82 may be folded over the end flaps 78 so that the end flaps 78 are captured between the inner side panels 82 and the outer side panels 80.

A pair of optional side flaps 84 may be foldably attached to each inner side panel 82 along a fold line 85.

Method of Assembly

The tub support system 10 may be assembled by first assembling the lower tub support 12 and the upper tub support 14, then locking the two components together as explained below.

Assembling the Lower Tub Support 12

Fold or rotate each vertical panel 34 upwards/inwards (toward each other) about ninety degrees until the vertical panels 34 are substantially perpendicular to the top panels 32.

Fold or rotate each top panel 32 upwards/inwards almost 180 degrees about the side fold line 24 until the vertical panels 34 meet and the bottom tabs 38 extend through the center slot 28.

Optionally, fold or rotate each bottom tab 38 ninety degrees outward 9awaty from each other) to lock the lower tub support 12 in its assembled configuration.

The entire assembly process for the lower tub support 12 may be done by an operator on site in just a few seconds, prior to installing the lower tub support 12 into a washing machine 50.

Installing the Lower Tub Support 12

Insert the lower tub support 12 into the top opening 60 of a washing machine 50 until the curved ends of the lower tub support 12 abut or otherwise contact opposing sides/areas of the wash tub 52. Preferably the lower tub support 12 fits snugly within the tub 52 and is in a substantially horizontal orientation as shown in FIG. 1. The lower tub support 12 may be wedged (in the vertical dimension) between the agitator 61 and an overhanging portion of the wash tub 52.

Assembling the Upper Tub Support 14

Fold or rotate each vertical panel 34 upwards/inwards (toward each other) about ninety degrees until the vertical panels 34 are substantially perpendicular to the top panels 32.

Fold or rotate each top panel 32 upwards/inwards almost 180 degrees about the side fold line 24 until the vertical panels 34 meet and the bottom tabs 38 extend through the center slot 28.

Optionally, fold or rotate each bottom tab 38 ninety degrees outward (away from each other) to lock the lower tub support 12 in its assembled configuration.

Installing the Upper Tub Support 14

Insert the upper tub support 14 into the top opening 60 of the washing machine 50 so that the gap 90 receives the middle portion 35 of the lower tub support 12 in snug fashion, thereby locking the two components together as shown in FIG. 2. This single step simultaneously completes the assembly and installation of the tub support system 10.

In the assembled and installed tub support system 10, the upper tub support 14 should be oriented perpendicularly to the lower tub support 12, and the ends of the upper tub support 14 should abut opposing sides/areas of the cabinet 54. Thus the tub support system 10 contacts both the wash tub 52 and the cabinet 54 at multiple areas to prevent the wash tub 52 from moving relative to the outer cabinet 54 during shipping and handling. More specifically, the lower tub support 12 contacts the tub 52 and the upper tub support 14 contacts the cabinet 54 in the vicinity of the cabinet rim 58.

It should be understood that the order of the assembly steps can vary from that described above and still be in keeping with the scope and objective of this disclosure.

INDUSTRIAL APPLICABILITY

Thus there has been described a tub support system for preventing relative movement of a wash tub and cabinet to prevent damage to the cabinet or other parts of a washing machine. The tub support system is made from two separate folded blanks and can be quickly and easily assembled and installed.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A tub support system for a washing machine of a type having a wash tub located within a cabinet, the cabinet having a top surface having a rim defining a top opening, the tub support system comprising:

a lower tub support made from a first single, folded blank and configured to contact opposing areas of the wash tub, wherein, after the lower tub support is formed by folding the first single, folded blank, the lower tub support has two parallel side edges and a side notch along each side edge so that the side notches define a relatively narrow middle portion of the lower tub support so that the lower tub support has a barbell shape with the middle portion being a narrow portion of the barbell shape; and an upper tub support made from a second single, folded blank and configured to contact opposing areas of the cabinet; wherein:

the upper tub support defines a gap configured to receive and engage the middle portion of the lower tub support to lock the upper tub support and the lower tub support together in a substantially perpendicular orientation; and the engagement of the middle portion of the lower tub support and the upper tub support prevents significant movement of the wash tub relative to the cabinet.

2. The tub support system of claim 1 wherein the lower tub support comprises:

a bottom panel having the two parallel side edges and two opposing contoured free edges, the bottom panel defining a center slot parallel to the side edges; and a top panel foldably attached to each side edge;

wherein each side notch is defined by the bottom panel and one of the top panels, each side notch straddling one of the side edges.

3. The tub support system of claim 2 wherein the lower tub support further comprises:

a vertical panel foldably attached to each top panel along a second fold line; and a bottom tab foldably attached to each vertical panel along a tab fold line and inserted through the center slot.

4. The tub support system of claim 1 wherein the upper tub support comprises:

a bottom wall defining the gap and comprising first and second bottom panels separated by the gap, the bottom wall and having a perimeter defined by opposing bottom side fold lines and opposing bottom end fold lines;

an end panel foldably attached to and extending upwardly from each bottom panel along each bottom end fold line; and a side wall foldably attached to and extending upwardly from the bottom panels along each bottom side fold line and terminating in a top edge.

5. The tub support system of claim 4 wherein the side wall comprises:

an outer side panel foldably attached to and extending upwardly from the bottom panels along each bottom side fold line and terminating in a top edge defined by a side panel fold line; and an inner side panel foldably attached to each outer side panel along one of the side panel fold lines and extending downward therefrom.

6. The tub support system of claim 5 wherein the upper tub support further comprises:

a pair of end flaps foldably attached to each end panel along a fold line, each end flap being in flat facing relationship with one of the outer side panels.

7. The tub support system of claim 2 wherein the upper tub support comprises:

a bottom wall defining the gap and comprising first and second bottom panels separated by the gap, the bottom wall and having a perimeter defined by opposing bottom side fold lines and opposing bottom end fold lines;

an end panel foldably attached to and extending upwardly from each bottom panel along each bottom end fold line; and a side wall foldably attached to and extending upwardly from the bottom panels along each bottom side fold line and terminating in a top edge.

8. The tub support system of claim 4 wherein:

the lower tub support has a bottom panel having the two parallel side edges.

9. The tub support system of claim 8 wherein:

each side wall of the upper tub support defines a steepled notch configured to receive a complementary shaped portion of the lower tub support.

10. The tub support system of claim 9 wherein:

the steepled notch comprises two substantially vertical edges and two upwardly slanted top edges that meet at an apex.

11. A lower tub support for a washing machine of a type having a wash tub located within a cabinet, the cabinet having a top surface having a rim defining a top opening, the lower tub support made from a single, folded blank, the lower tub support comprising:

a bottom panel having two parallel side edges and two opposing contoured free edges, the bottom panel defining a center slot parallel to the side edges;

a top panel foldably attached to each side edge;

two side notches, each side notch defined by the bottom panel and one of the top panels, each side notch straddling one of the side edges;

a vertical panel foldably attached to each top panel along a second fold line; and a bottom tab foldably attached to each vertical panel along a tab fold line and inserted through the center slot; wherein the lower tub support is configured to contact opposing areas of the wash tub.

12. An upper tub support for a washing machine of a type having a wash tub located within a cabinet, the cabinet having a top surface having a rim defining a top opening, the top opening having a depth, the upper tub support made from a single, folded blank, the upper tub support comprising:

a bottom wall comprising first and second bottom panels separated by a gap, the bottom wall and having a perimeter defined by opposing bottom side fold lines and opposing bottom end fold lines;

an end panel foldably attached to and extending upwardly from each bottom panel along each bottom end fold line;

an outer side panel foldably attached to and extending upwardly from the bottom panels along each bottom side fold line and terminating in a top edge defined by a side panel fold line;

an inner side panel foldably attached to each outer side panel along one of the side panel fold lines and extending downward therefrom; and a pair of end flaps foldably attached to each end panel along a fold line, each end flap being in flat facing relationship with one of the outer side panels; wherein the upper tub support is configured to contact opposing areas of the cabinet.

* * * * *